US008292577B2

(12) United States Patent
Burias

(10) Patent No.: US 8,292,577 B2
(45) Date of Patent: Oct. 23, 2012

(54) REMOVABLE IMPELLER FOR FAN

(75) Inventor: Olivier Burias, Neufmoutiers en Brie (FR)

(73) Assignee: Aereco (FR)

( * ) Notice: Subject to any disclaimer, the term of this patent is extended or adjusted under 35 U.S.C. 154(b) by 1217 days.

(21) Appl. No.: 12/067,926

(22) PCT Filed: Sep. 22, 2006

(86) PCT No.: PCT/FR2006/002170

§ 371 (c)(1),
(2), (4) Date: Mar. 24, 2008

(87) PCT Pub. No.: WO2007/034086

PCT Pub. Date: Mar. 29, 2007

(65) Prior Publication Data

US 2008/0226447 A1 Sep. 18, 2008

(30) Foreign Application Priority Data

Sep. 22, 2005 (FR) ..... 05 09674

(51) Int. Cl.
*F04D 1/00* (2006.01)

(52) U.S. Cl. ..... 415/206; 416/204 A

(58) Field of Classification Search ..... 416/170 R, 416/204 R, 204 A; 415/206, 214.4, 214.1; 301/111.01–111.04, 111.07, 120–122, 37.31, 301/37.33–37.36, 28, 110, 5.1, 11.2, 132, 301/37.106, 37.104, 112

See application file for complete search history.

(56) References Cited

U.S. PATENT DOCUMENTS

| | | | | |
|---|---|---|---|---|
| 3,870,371 | A * | 3/1975 | Solomon | 301/1 |
| 5,215,356 | A * | 6/1993 | Lin | 301/111.07 |
| 5,716,107 | A * | 2/1998 | Parker et al. | 301/111.07 |
| 2002/0090299 | A1 * | 7/2002 | Chuang | 416/182 |
| 2004/0075356 | A1 * | 4/2004 | Horng et al. | 310/154.08 |
| 2005/0287005 | A1 * | 12/2005 | Gruber et al. | 416/244 R |
| 2008/0226447 | A1 * | 9/2008 | Burias | 415/206 |

FOREIGN PATENT DOCUMENTS

| | | | |
|---|---|---|---|
| DE | 90 17 544 | | 3/1991 |
| DE | 100 49 341 | | 4/2002 |
| DE | 10049341 | A1 * | 4/2002 |
| EP | 1 008 776 | | 6/2000 |
| EP | 1008776 | A1 * | 6/2000 |
| FR | 2 816 380 | | 5/2002 |
| GB | 2 017 261 | | 10/1979 |

OTHER PUBLICATIONS

International Search Report; PCT/FR2006/002170; Feb. 12, 2007.

* cited by examiner

*Primary Examiner* — Edward Look
*Assistant Examiner* — Christopher R Legendre
(74) *Attorney, Agent, or Firm* — Cantor Colburn LLP

(57) ABSTRACT

The invention concerns a removable impeller (7) designed to be integrated in a fan (1), in particular for controlled mechanical ventilation, and configured in the shape of a wheel provided with a plurality of blades (8) and equipped with locking clips to enable its being fixed on a hub. The invention is characterized in that it includes projecting transmitting clips, arranged proximate a central neck having an axis of revolution that is parallel to that of the wheel, and designed so as to enable the locking clips to be alternately engaged or released. The invention also concerns a fan including such an impeller.

11 Claims, 11 Drawing Sheets

REMOVABLE IMPELLER FOR FAN

TECHNICAL FIELD OF THE INVENTION

The present invention relates to a removable impeller designed to be incorporated into a fan, particularly for controlled mechanical ventilation, and made in the form of a wheel furnished with a plurality of blades and fitted with locking means to allow it to be attached to a hub, and a hub and a latch designed to interact with said impeller.

BRIEF DESCRIPTION OF RELATED ART

Many systems, such as for example hygrometrically adjustable opening systems used in controlled mechanical ventilation, require the use of a fan providing air suction that is constant over time. This constant suction may be obtained at a reduced cost by regulating the speed of a motor driving an impulse impeller. Nevertheless, the disadvantage of such an impulse impeller is that it is sensitive to clogging by the dust and grease contained in the extracted air.

A first known solution to overcome this problem consists in permanently attaching the impeller to the associated motor, and placing a filter upstream of the fan. However, this filter creates a loss of pressure that is unfavorable to the efficiency of the system, is bulky, is of no small cost, and needs to be changed or cleaned regularly.

A second known solution consists in the use of a removable impeller, capable of being cleaned once removed. The systems fitted with such an impeller provide for the latter to be attached by screwing to a shaft. This step is nevertheless relatively awkward to carry out, particularly in the case of controlled mechanical ventilation since the occupant of the dwelling himself carries out the removal and the cleaning.

BRIEF SUMMARY OF THE INVENTION

The invention remedies these disadvantages and for this purpose comprises a removable impeller designed to be incorporated into a fan, particularly for controlled mechanical ventilation, and made in the form of a wheel furnished with a plurality of blades and fitted with locking means to allow it to be attached to a hub, characterized in that it comprises protruding transmission means positioned close to a central neck whose axis of revolution is parallel to that of the wheel, and designed so as to alternately allow the engagement or extraction of the locking means.

According to a first preferred embodiment of the invention, the locking means are arranged in the central neck in the form of a first series of locking clips evenly spaced from one another and each provided at the bottom with a radial swelling oriented outward. In addition, each locking clip preferably has at the bottom a radial shoulder oriented inward.

Advantageously, the transmission means are arranged in the central neck in the form of a second series of transmission clips evenly spaced from one another and interspersed with the locking clips, each transmission clip being fitted with a first stop and a second stop positioned one beneath the other and oriented inward, said first stop forming a more pronounced protrusion than the second stop.

Again advantageously, the first stop is arranged at the top, and the second stop is made in the form of a longitudinal boss extending in the mid-portion, and extended by an inclined face at each of its top and bottom ends.

The present invention also relates to a hub and to a latch designed so as to be able to interact with such an impeller. The hub preferably comprises a lateral wall in which a series of notches is made, each of them being capable of housing one of the locking means of the impeller, and the latch comprises a gripping member and means capable of sliding through the central neck of the impeller. Again preferably, the gripping member is extended by a series of longitudinal flat walls interspersed with a series of longitudinal hollow walls, said flat walls and hollow walls being evenly spaced from one another and being capable of sliding through the central neck of the impeller.

In such a configuration, it is then possible to carry out sequenced opening and closing.

Specifically, when the operator applies a sufficient pull to the gripping member of the latch, the transmission clips having a greater radial stiffness than that of the hollow walls, each hollow wall sustains an elastic deformation so that the bottom portion of its contour is made to slide successively along the inclined bottom face, the boss, and finally the top inclined face of the second stop. The hollow wall then returns to its rest position in the gap separating the first stop from the second stop, and the bottom portion of the contour finally comes into contact with the first stop. This being so, the flat walls of the latch are no longer positioned facing the locking clips, and the latter may be extracted from the notches presented by the hub if the operator continues to exert a sufficient pull on the gripping member. The impeller and its latch are then separated from the hub, and it is possible to clean the blades of the impeller. This removal is therefore carried out in a single, two-stage movement simply, rapidly and toollessly.

Once the impeller is properly cleaned, the operator takes the gripping member of the latch and correctly positions the impeller on its hub. All that is necessary then is to exert a sufficient push on the gripping member to force the bottom portion of the contour of each hollow wall to slide successively along the top inclined face, the boss, and finally the bottom inclined face. This being so, each flat wall of the latch slides along the associated locking clip, until the bottom end of its contour butts against the radial shoulder of the locking clip. This then has the effect of elastically deforming the locking clip outward so that its radial swelling is conveniently housed in the corresponding notch. This locking is therefore also carried out simply, rapidly and toollessly.

According to a preferred variant embodiment of the invention, the impeller comprises, on the periphery of the central neck, a central wall on which longitudinal ribs are made that are evenly spaced and oriented inward. In addition, the lateral wall of the hub is advantageously fitted on its outer face with V-shaped indexing means. Therefore, with such an arrangement, when the latch and the impeller are fitted to the associated hub, a sufficient push exerted on the gripping member, that is transmitted to the top inclined face of each second stop via the bottom portion of the contour of the corresponding hollow wall of the latch, makes it possible to automatically center the impeller on the hub. Specifically, this results from the fact that the top inclined face is designed so that the minimal stresses that need to be exerted by the longitudinal ribs of the impeller on the V-shaped indexing means to force the hub to pivot until it is perfectly oriented are less than those needed to cause the elastic deformation of each hollow wall because of the sliding of the bottom portion of its contour along said corresponding top inclined face. However, once the impeller is correctly positioned in abutment against the hub, the continued push exerted by the operator on the gripping member then has the effect of forcing the latch to slide through the central neck, until it locks the locking clips in the associated notches by means of its flat walls.

Once the impeller has been locked, the impeller is rotated by the hub by means of the longitudinal ribs.

The impeller, the latch and the hub are advantageously made of plastic molded parts.

According to a second preferred embodiment of the invention, the locking means comprises at least two magnets, and the transmission means comprises at least two link rods each comprising a first substantially cylindrical end having a longitudinal ridge forming a stop, and connected via a stem to a second protruding end parallel to the shaft of the first end.

The present invention also relates to a latch designed so as to interact with an impeller according to the second preferred embodiment of the invention. This latch advantageously comprises a gripping member extended by a longitudinal stem in which a circular groove is made.

The second end forming a protrusion of each link rod is housed in the circular groove of the latch so that the translation of the latter forces the first end of the link rod to start rotating.

Consequently, both in the first and the second preferred embodiment of the invention, it should therefore be well understood that the impeller and the latch may be extracted and put back in place by a single movement, simply, rapidly, without training and toollessly.

The present invention also relates to a fan particularly for controlled mechanical ventilation, comprising a body forming a volute in which a rotary motor is attached, a hub being fixedly attached to said motor and supporting a removable impeller provided with a central neck, a plurality of blades and fitted with locking means to allow it to be attached to the hub, characterized in that,

- the locking means are made in the central neck in the form of a first series of locking clips evenly spaced from one another and each provided at the bottom, on the one hand, with a radial swelling oriented outward, and, on the other hand, with a radial shoulder oriented inward,
- the impeller comprises transmission means made in the central neck in the form of a second series of clips evenly spaced from one another and interspersed with the locking clips, each transmission clip being fitted with a first stop and a second stop positioned one beneath the other and oriented inward, said first stop forming a more pronounced protrusion than the second stop, said first stop being made at the top and said second stop being made in the form of a longitudinal boss, extending in the mid-portion, respectively extended by a steeply inclined face at its top end and by a slightly inclined face at its bottom end,
- the hub comprises a lateral wall in which a series of notches is made, each of them being capable of housing one of the locking clips of the impeller,
- a latch is fitted to the impeller, this latch comprising a gripping member extended by a series of longitudinal flat walls interspersed with a series of longitudinal hollow walls, said flat walls and hollow walls being evenly spaced from one another and being capable of sliding through the central neck so that each is respectively placed facing a locking clip and a transmission clip.

BRIEF DESCRIPTION OF THE DRAWINGS

The invention will be better understood with the aid of the detailed description that is given below with respect to the appended drawing in which.

DETAILED DESCRIPTION OF THE INVENTION

Figure 1:
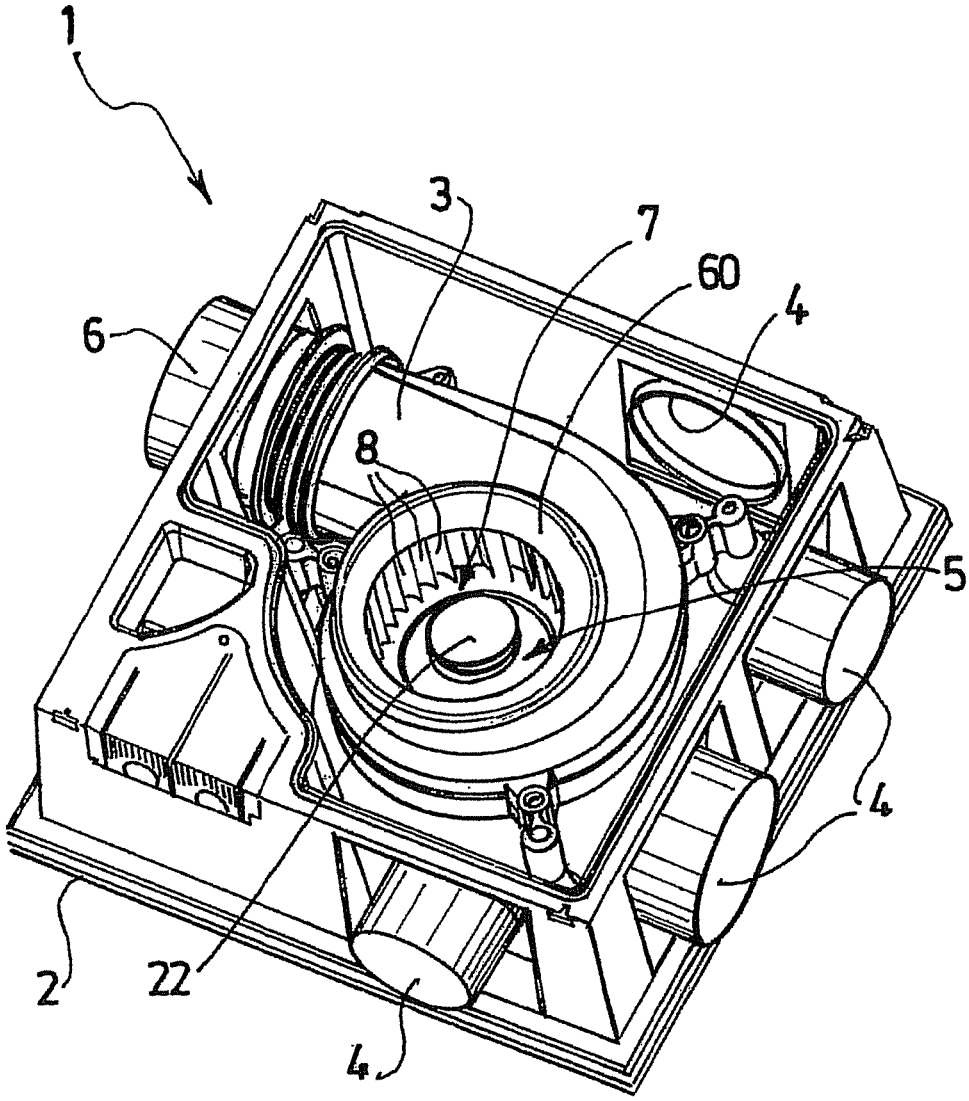
FIG. 1 is a view in perspective of a fan according to the invention, with the cover omitted.

A fan 1 according to the invention, as shown in FIG. 1, is designed for controlled mechanical ventilation and comprises a casing 2 whose cover has been omitted, and in which a volute 3 is attached.

The casing 2 has four air inlet connectors 4 and each of them is placed in relation with a room of the dwelling to be ventilated by means of an aeration duct (not shown).

The volute 3 is made of plastic and conventionally comprises an air inlet 5 and an air outlet 6, the air inlet 5 being bordered by a removable ear 60 attached with the aid of clips (not shown).

Figure 2:
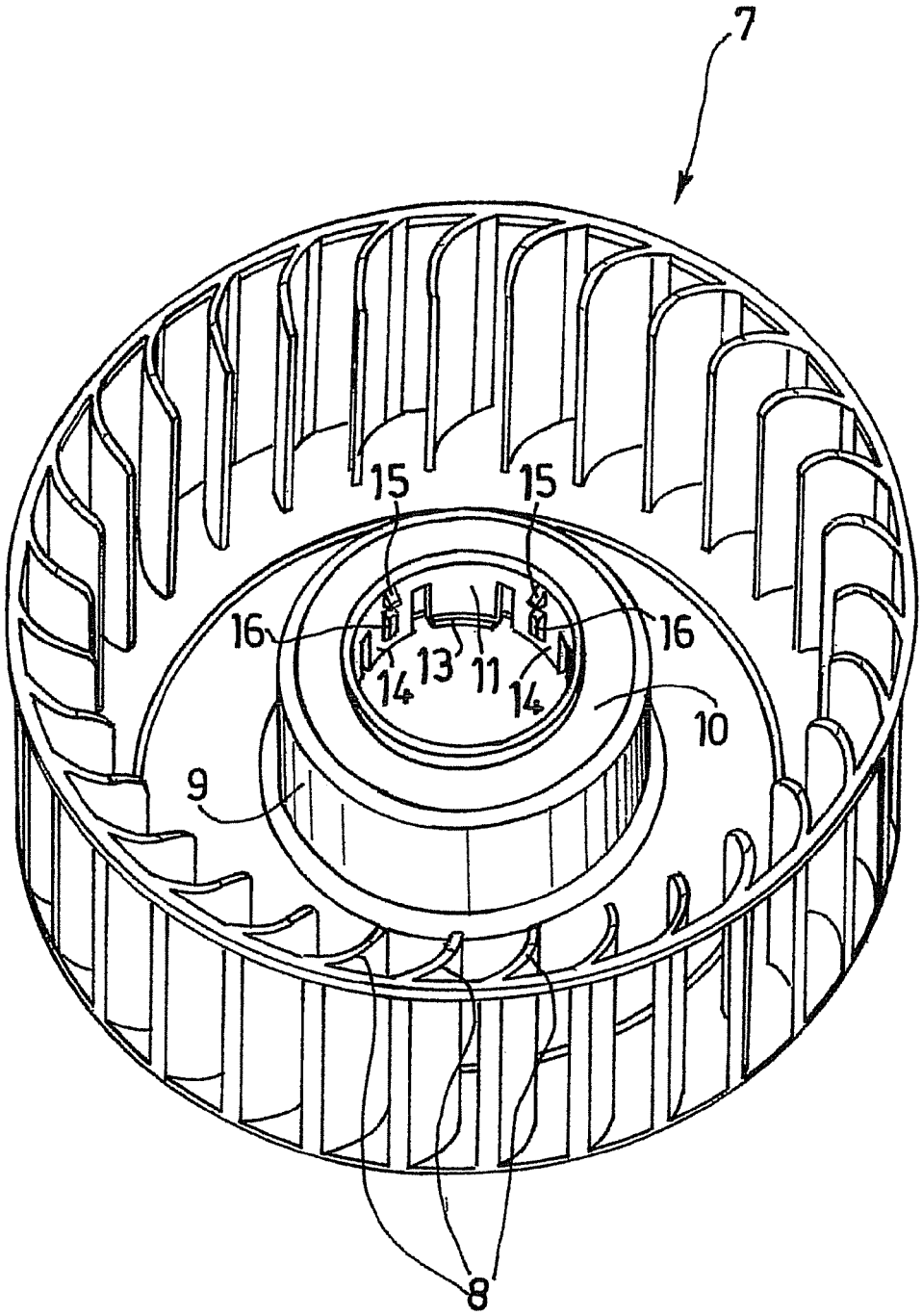
FIG. 2 is a top view in perspective of an impeller according to a first preferred embodiment of the invention.
Figure 3:
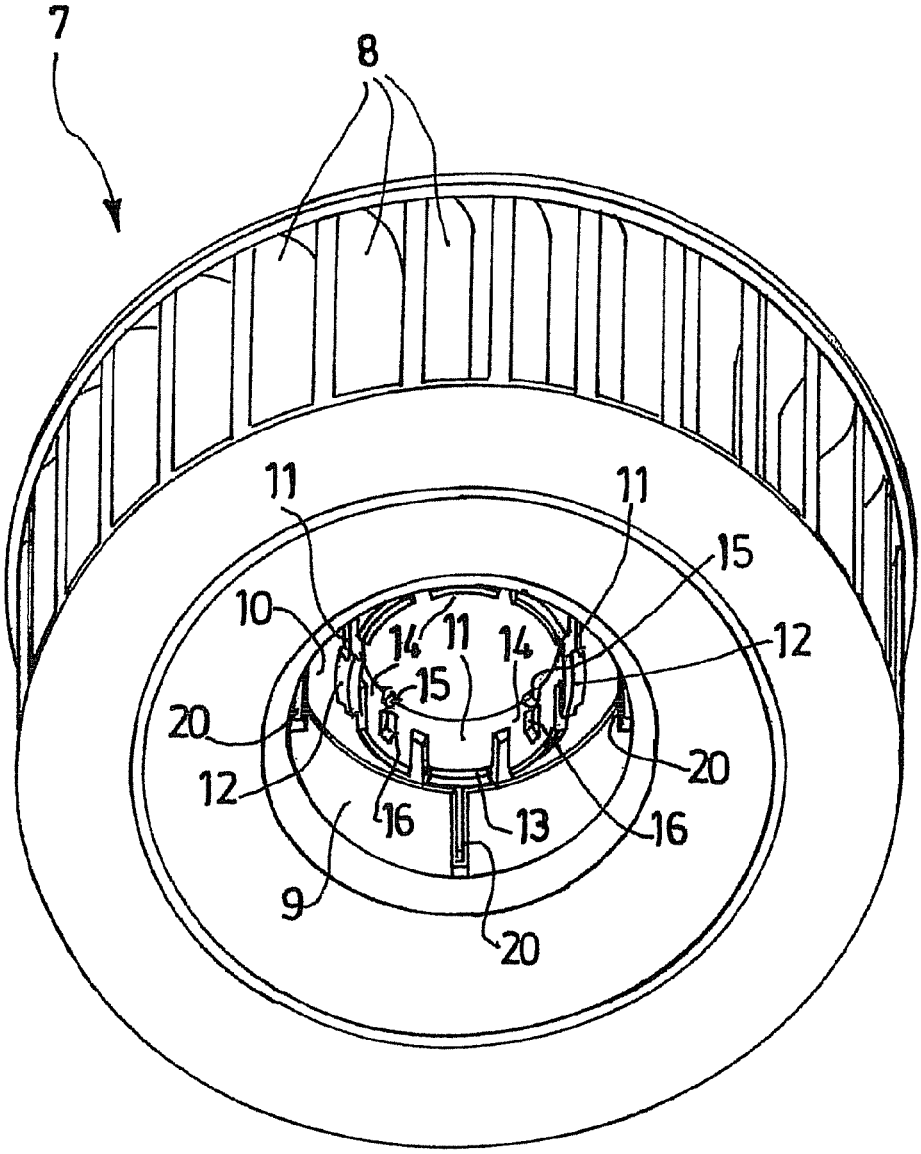
FIG. 3 is a bottom view in perspective of the impeller shown in FIG. 2.

As shown more specifically in FIGS. 1 to 3, the volute 3 contains an impeller 7, according to a first preferred embodiment of the invention, provided to create suction in the casing 2 so as to aspirate the contaminated air originating from the air inlet connectors 4. This impeller 7 is molded in plastic in the shape of a wheel fitted with a plurality of blades 8, and comprises a central wall 9 that is axisymmetric surrounding a central neck 10 whose vertical axis of revolution is indistinguishable from that of the wheel.

Again more precisely, four vertical locking clips 11 evenly spaced from one another are made in the central neck 10 of the impeller 7. Each locking clip 11 has at the bottom, on the one hand, a radial swelling 12 oriented outward, and, on the other hand, a radial shoulder 13 oriented inward.

In addition, four vertical transmission clips 14 evenly spaced from one another, interspersed with the locking clips 11 of the same length as the latter but wider so as to present increased resistance to radial deformation, are also made in the central neck 10.

Each transmission clip 14 is fitted with a first stop 15 and a second stop 16 oriented inward and made at a certain distance one beneath the other, said first stop 15 forming a more pronounced protrusion than the second stop 16. The first stop 15 is made in the top of the central neck 10, and the second stop 16 is made in the form of a vertical boss 17, extending in the mid-portion of the central neck 10, and extended by an inclined face 18, 19 at each of its top and bottom ends, the top inclined face 18 being more inclined than the bottom inclined face 19.

Furthermore, four vertical ribs 20 evenly spaced from one another and oriented inward are made in the central wall 9 facing the central neck 10.

Figure 4:
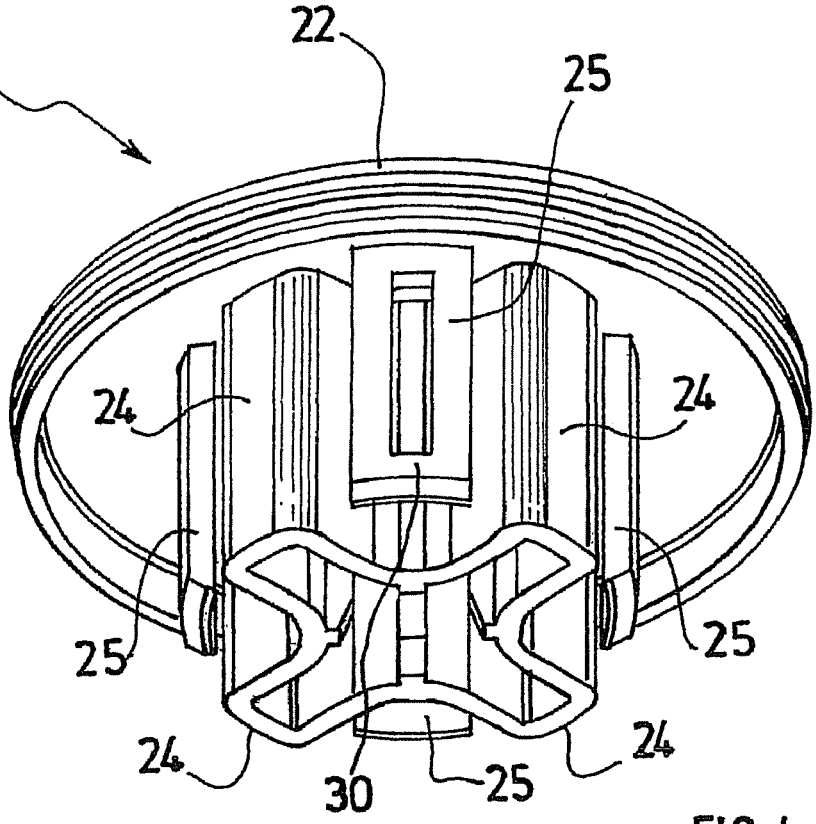
FIG. 4 is a view in perspective of a latch according to the invention capable of interacting with the impeller shown in FIG. 2.

As shown in FIG. 4, a latch 21 according to the invention capable of interacting with the impeller 7 is molded in plastic and is divided into a gripping member 22 of diskoid shape extended by four flat longitudinal walls 24 oriented outward and interspersed with four longitudinal hollow walls 25, said flat walls 24 and hollow walls 25 being evenly spaced from one another and of the same length.

The flat walls 24 are in fact connected together by plastic so as to form a rigid subassembly in the shape of a cross in cross section, which makes it possible to prevent any radial deformation of the flat walls 24.

In addition, it should be well understood that this latch 21 is designed so that, on the one hand, the distance separating two diametrically opposed flat walls or two hollow walls is very slightly less than that separating two diametrically opposed clips of the impeller 7, and on the other hand, the length of said flat walls 24 and hollow walls 25 is sufficient to act respectively on the swellings 12 and the shoulders 13 presented by the locking clips 11 and the transmission clips 14 of the impeller 7 when the latch 21 is inserted.

Figure 5:
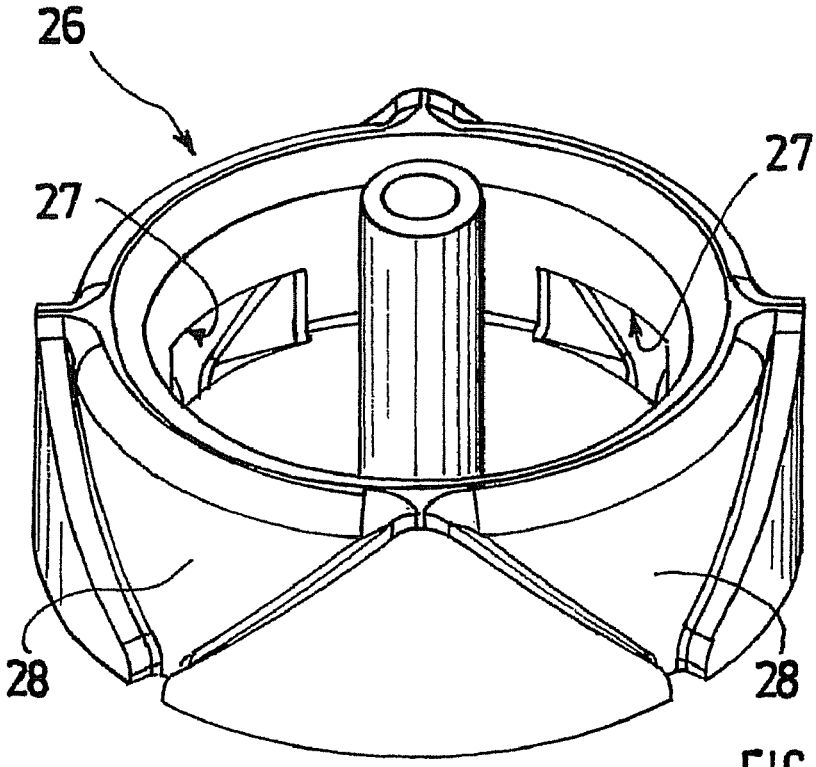
FIG. 5 is a view in perspective of a hub according to the invention capable of interacting with the impeller shown in FIG. 2.
Figure 6:
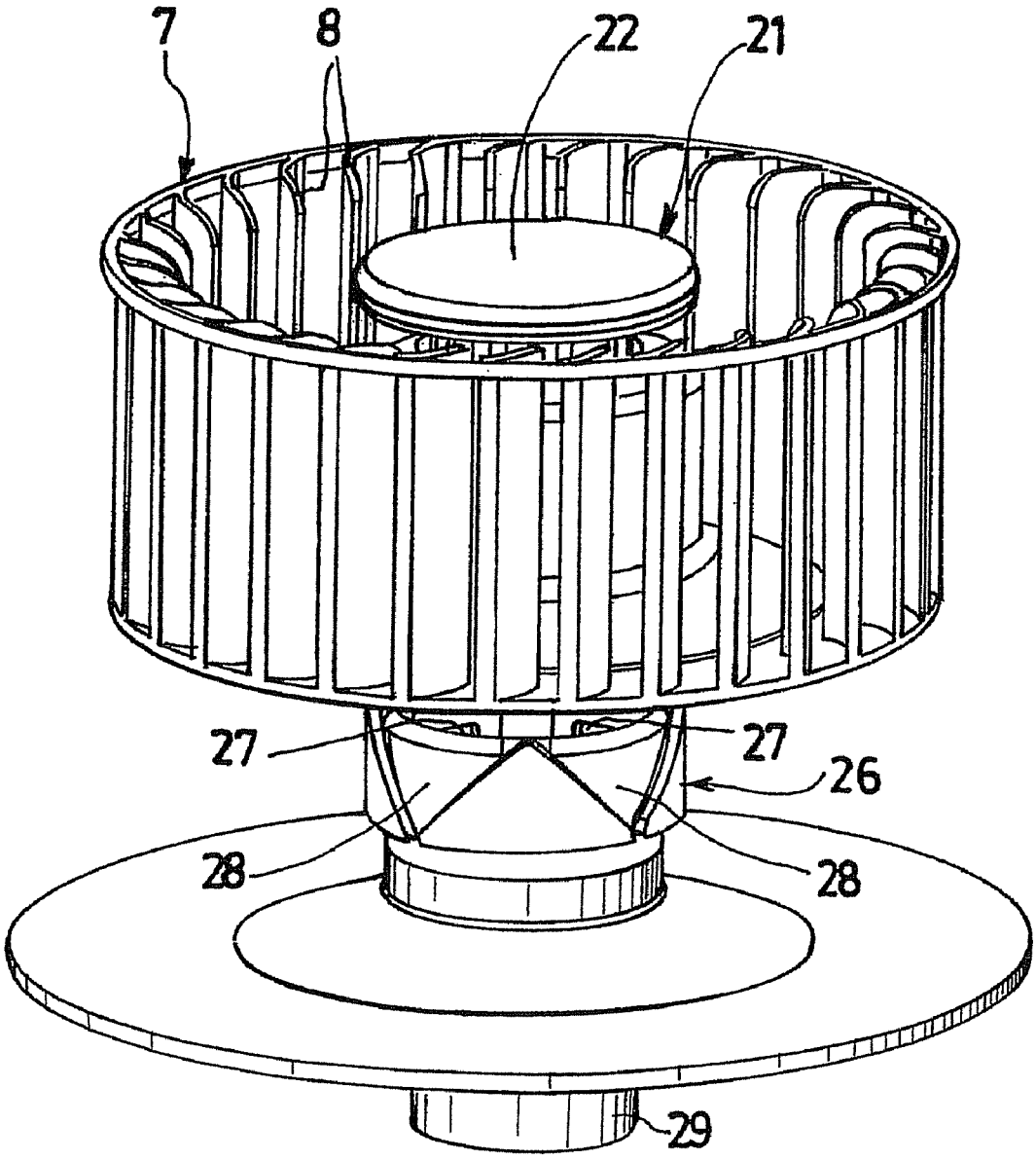
FIG. 6 is a view in perspective of the impeller shown in FIG. 2 with its latch, before attachment to its corresponding hub.

As shown in FIG. 5, a hub 26 according to the invention, capable of interacting with the impeller 7, is molded in plastic, and comprises a lateral wall in which four notches 27 have been made evenly spaced from one another and sufficiently wide for each to house one of the locking clips 11 of the impeller 7. In addition, this lateral wall is fitted on its outer face with four V-shaped indexing means 28, evenly spaced from one another.

As shown schematically in FIGS. 6 to 11, the hub 26 is made fixedly attached to a rotary motor 29 attached in the volute 3 (not shown).

Figure 9:
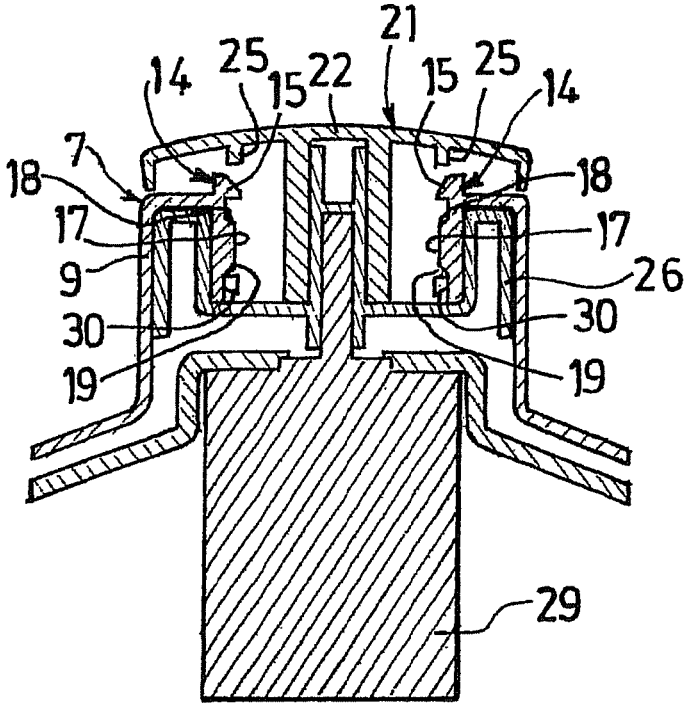
FIG. 9 is a view in section along the line B-B of the assembly shown in FIG. 7, the latch being in the closed position.
Figure 11:
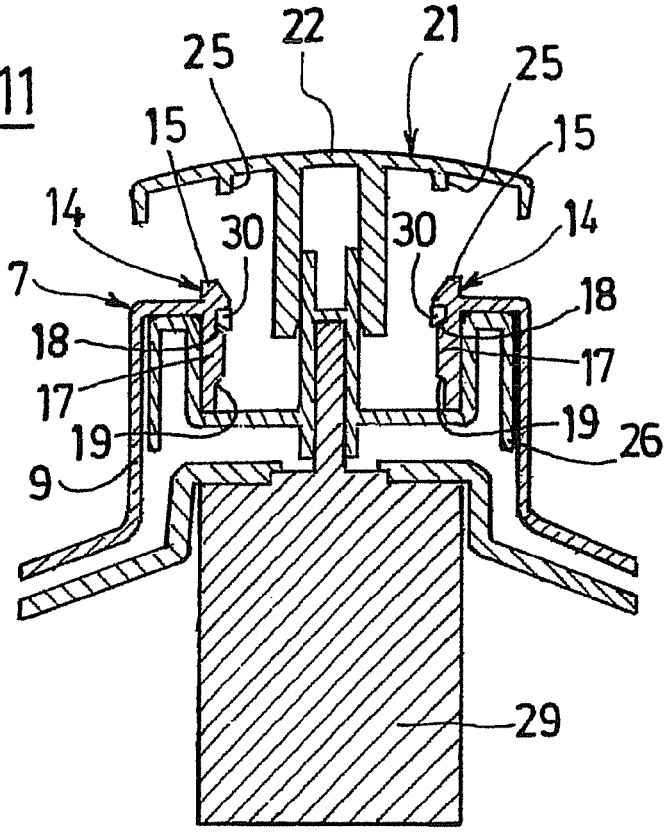
FIG. 11 is a view in section along the line B-B of the assembly shown in FIG. 7, the latch being in the open position.
Figure 12:
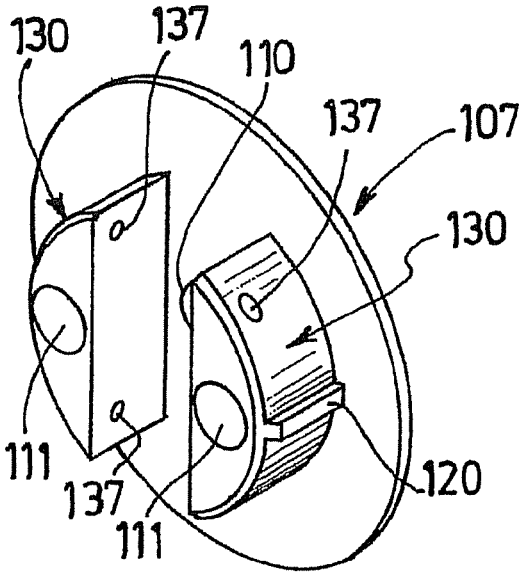
FIG. 12 is a view in perspective of an impeller according to the second preferred embodiment, with the link rods omitted.
Figure 13:
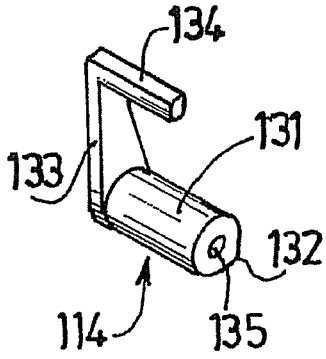
FIG. 13 is a view in perspective of a link rod.
Figure 14:
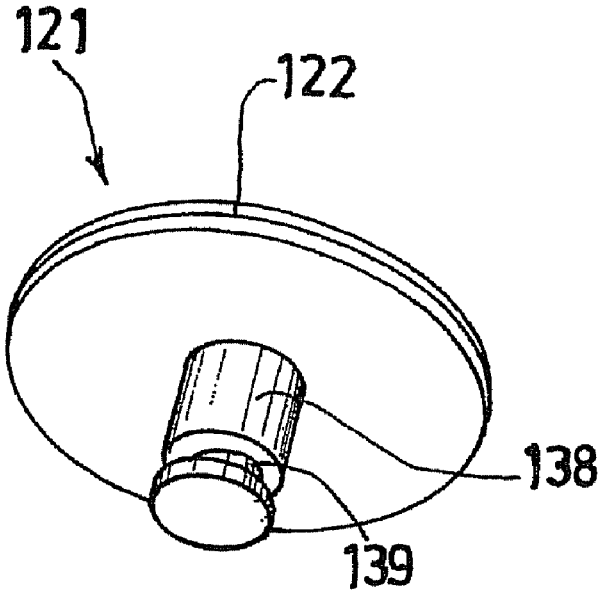
FIG. 14 is a view in perspective of a latch according to the invention capable of interacting with the impeller shown in FIG. 12.
Figure 15:
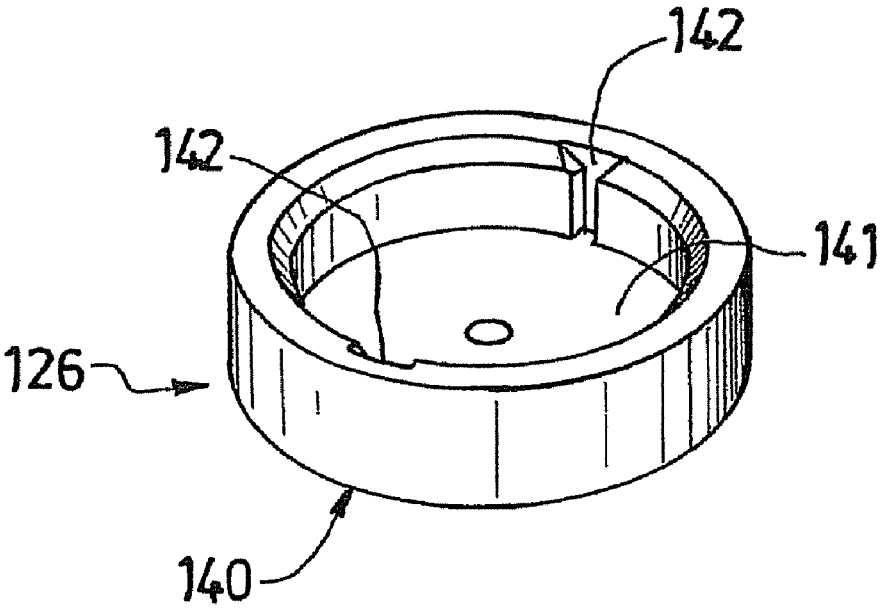
FIG. 15 is a view in perspective of a hub according to the invention capable of interacting with the impeller shown in FIG. 12.

When the fan 1 is installed in the dwelling of the end user, the impeller 7 and its latch 21 have previously been attached to the hub 26 at the factory. It should be noted that this latch 21 can therefore move only between two extreme positions, namely, on the one hand, as shown in FIG. 11, an open position in which the bottom portion 30 of the contour of each hollow wall 25 is held latched against the first stop 15 and the top inclined face 18 of the second stop 16 of the associated transmission clip 14, and on the other hand, as shown in FIG. 9, a closed position in which the bottom portion 30 of the contour of each hollow wall 25 is held latched by the bottom inclined face 19 of the second stop 16 of the associated transmission clip 14.

When the user wishes to clean the impeller 7 after a certain period of time, he then acts in the following manner.

First of all, he begins by unclipping the removable ear 60 by pulling thereon.

Figure 8:
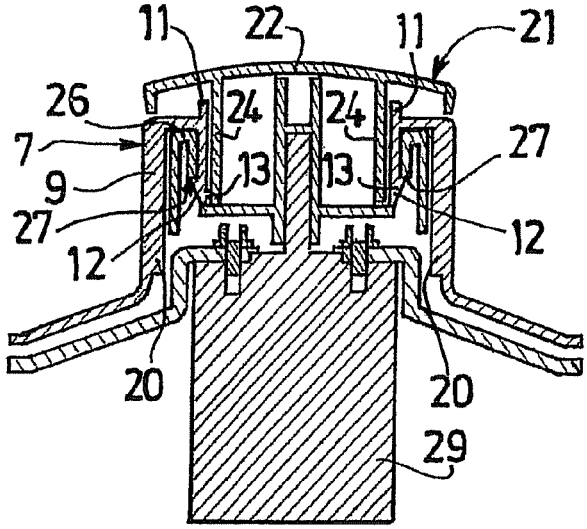
FIG. 8 is a view in section along the line A-A of the assembly shown in FIG. 7, the latch being in the closed position.
Figure 7:
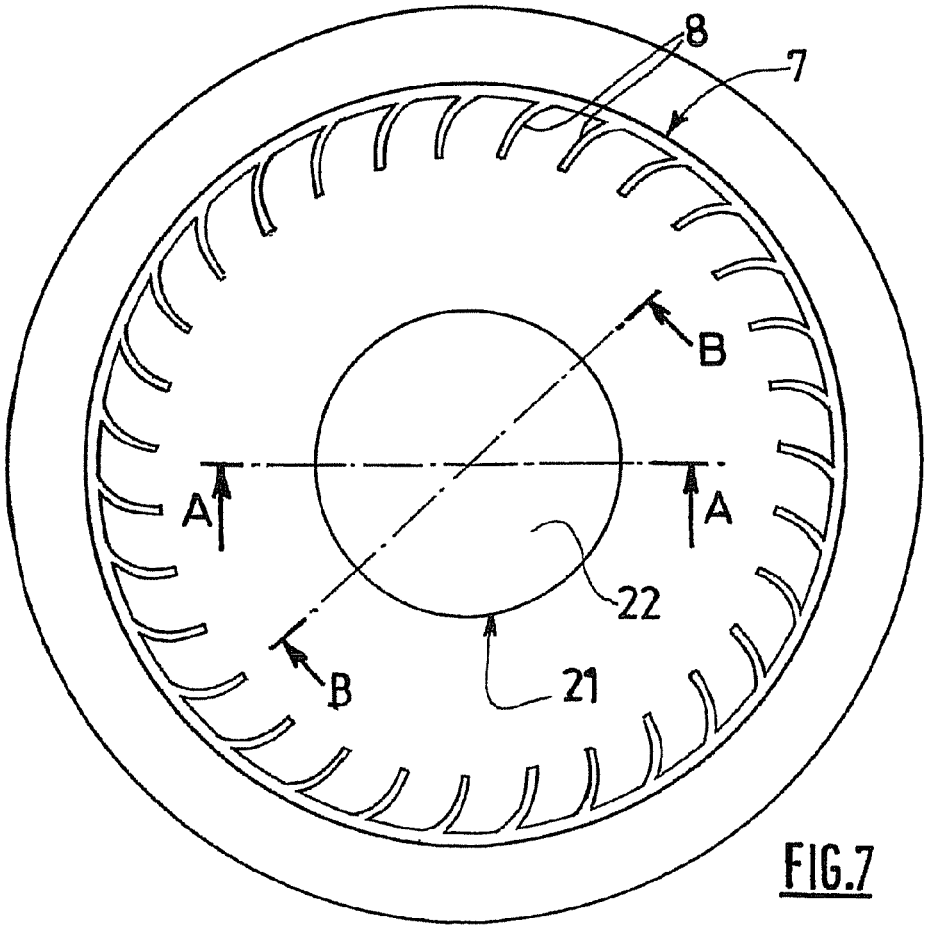
FIG. 7 is a top view of the impeller shown in FIG. 6, once attached to its hub.

Once this operation is complete, the user grasps the gripping member 22 of the latch 21 and pulls. The latch 21 which was hitherto in the closed position, as shown in FIGS. 8 and 9, is then made to slide upward. Specifically, the radial stiffness of the hollow walls 25 being less than that of the transmission clips 14, the pull exerted has the effect of forcing the bottom portion 30 of the contour of each hollow wall 25 to deform elastically during the successive sliding along the bottom inclined face 19, the boss 17, and finally the top inclined face 18 of the transmission clip 14 placed opposite.

Figure 10:
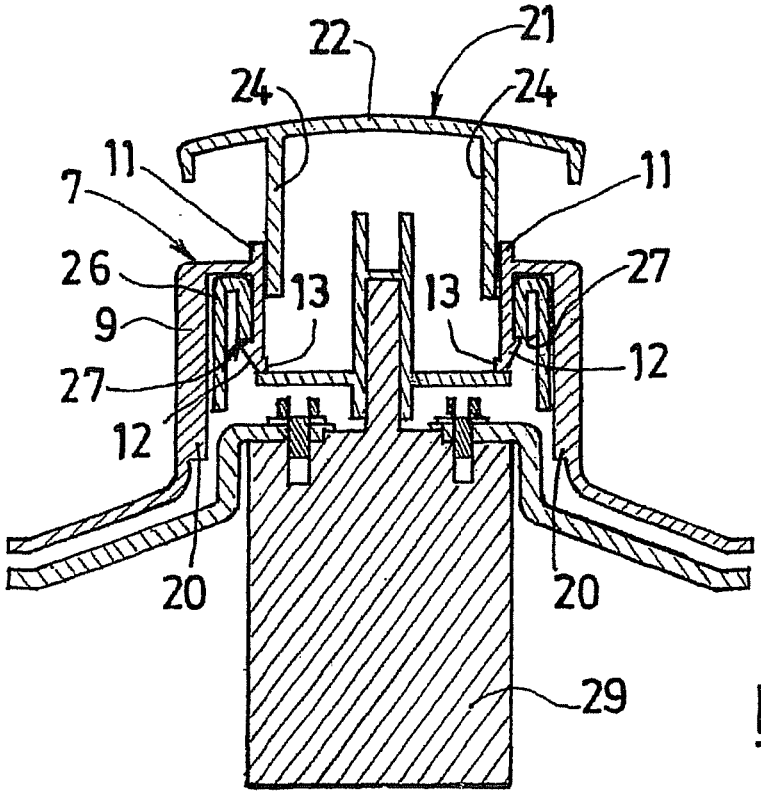
FIG. 10 is a view in section along the line A-A of the assembly shown in FIG. 7, the latch being in the open position.

As shown in FIGS. 10 and 11, each hollow wall 25 returns to its rest position when the bottom portion 30 emerges into the space separating the second stop 16 from the first stop 15. The bottom portion 30 then comes into contact with the latter that has been designed to protrude sufficiently to form a bump stop.

The continuation of the pulling movement forces the swelling 12 of each locking clip 11 to butt against the top edge of the corresponding notch 27. Now that the flat wall 24 associated with each locking clip 11 is no longer there to serve as a radial stop, it follows that each locking clip 11 sustains a radial elastic deformation oriented inward. Each swelling 12 is finally extracted from its corresponding notch 27 under the pulling effect and the subassembly formed by the impeller 7 and the latch 21 is separated from the fan 1. The user, who has carried out a rapid, simple and toolless removal of the impeller 7, may then clean the blades 8 of the latter.

Once the cleaning operation is complete, the user fits the subassembly formed by the impeller 7 and the latch 21 onto the associated hub 26 and exerts a sufficient vertical push on the gripping member 22. This vertical push is transmitted to the top inclined face 18 of each second stop 16 via the bottom portion 30 of the contour of the corresponding hollow wall 25 of the latch 21 and makes it possible to automatically center the impeller 7 on the hub 26.

Specifically, this results from the fact that the top inclined face 18 is designed so that the minimal stresses that need to be exerted via the vertical ribs 20 of the impeller 7 on the V-shaped indexing means 28 to force the hub 26 to pivot about its axis until it is perfectly oriented are less than those needed to cause the elastic deformation of each hollow wall 25 because of the sliding of the bottom portion 30 of its contour along said corresponding top inclined face 18.

However, once the impeller 7 is correctly positioned in abutment against the hub 26, the continuation of the vertical push exerted by the user then has the effect of forcing the latch 21 to slide through the central neck 10. More precisely, the bottom portion 30 of the contour of each hollow wall 25 is made to slide successively along the top inclined face 18, the boss 17 and finally the bottom inclined face 19. So doing, each flat wall 24 slides along the associated locking clip 11 until the bottom end of its contour butts against the radial shoulder 13 of said locking clip 11. This then has the effect of elastically deforming the locking clip 11 outward so that its radial swelling 12 is conveniently housed in the corresponding notch 27 of the hub 26. This locking is therefore also carried out simply, rapidly and toollessly.

Once the impeller 7 has been locked, the rotation of the latter via the hub 26 under the effect of the motor 29 is then carried out by means of the vertical ribs 20.

FIGS. 12 to 17 show an impeller 107 without its blades and according to the second preferred embodiment, and the associated latch 121 and hub 126.

The impeller 107 has a central neck 110 and differs mainly from the impeller 7 by the fact that it has at the bottom two protuberances 130, placed facing one another on either side of the central neck 110, each fitted with a magnet 111 forming a locking means, and each provided with a longitudinal rib 120 oriented outward.

Figure 16:
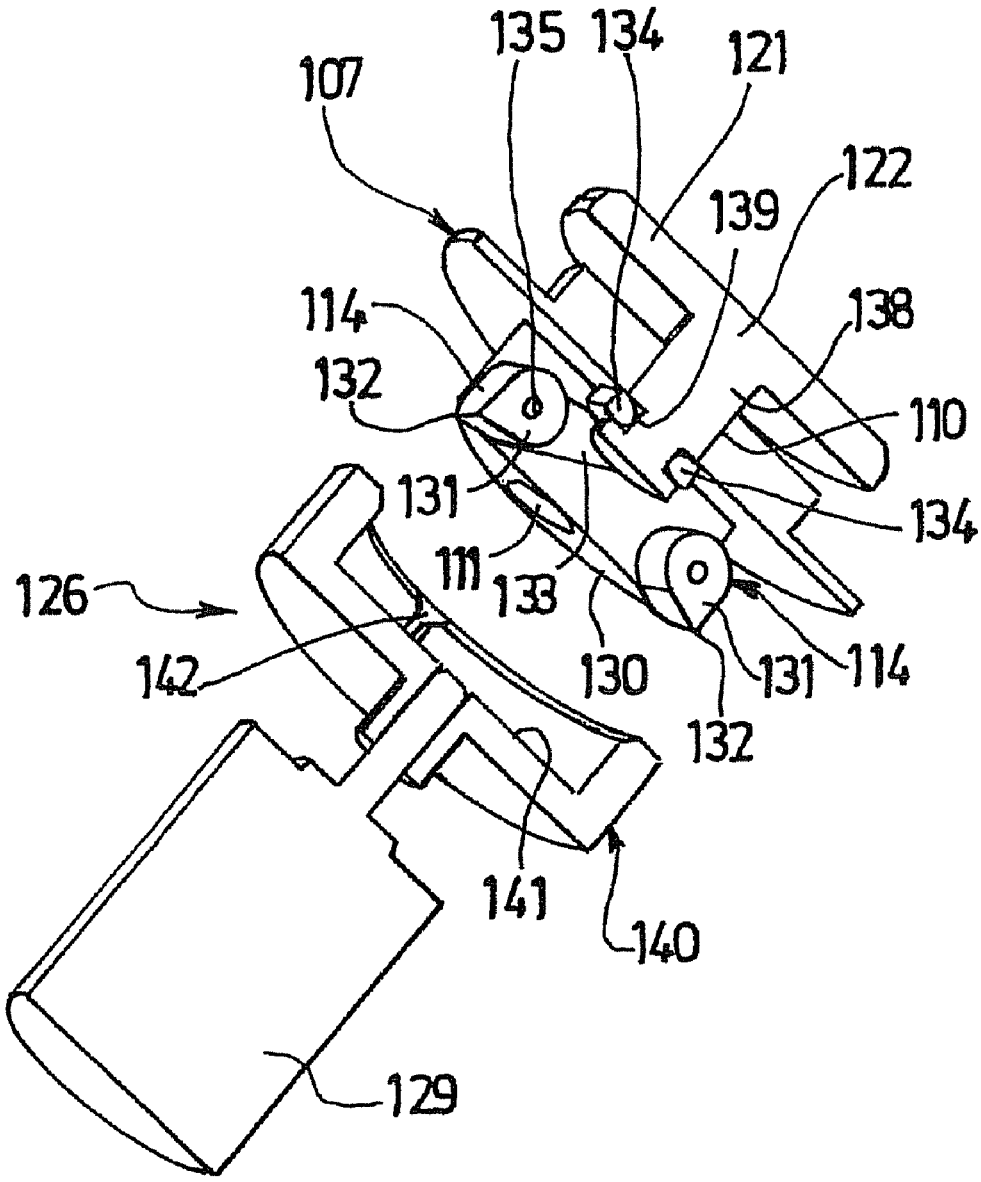
FIG. 16 is a view in perspective of a half of the impeller shown in FIG. 12, cut longitudinally at the link rods, before attachment to its corresponding hub.
Figure 17:
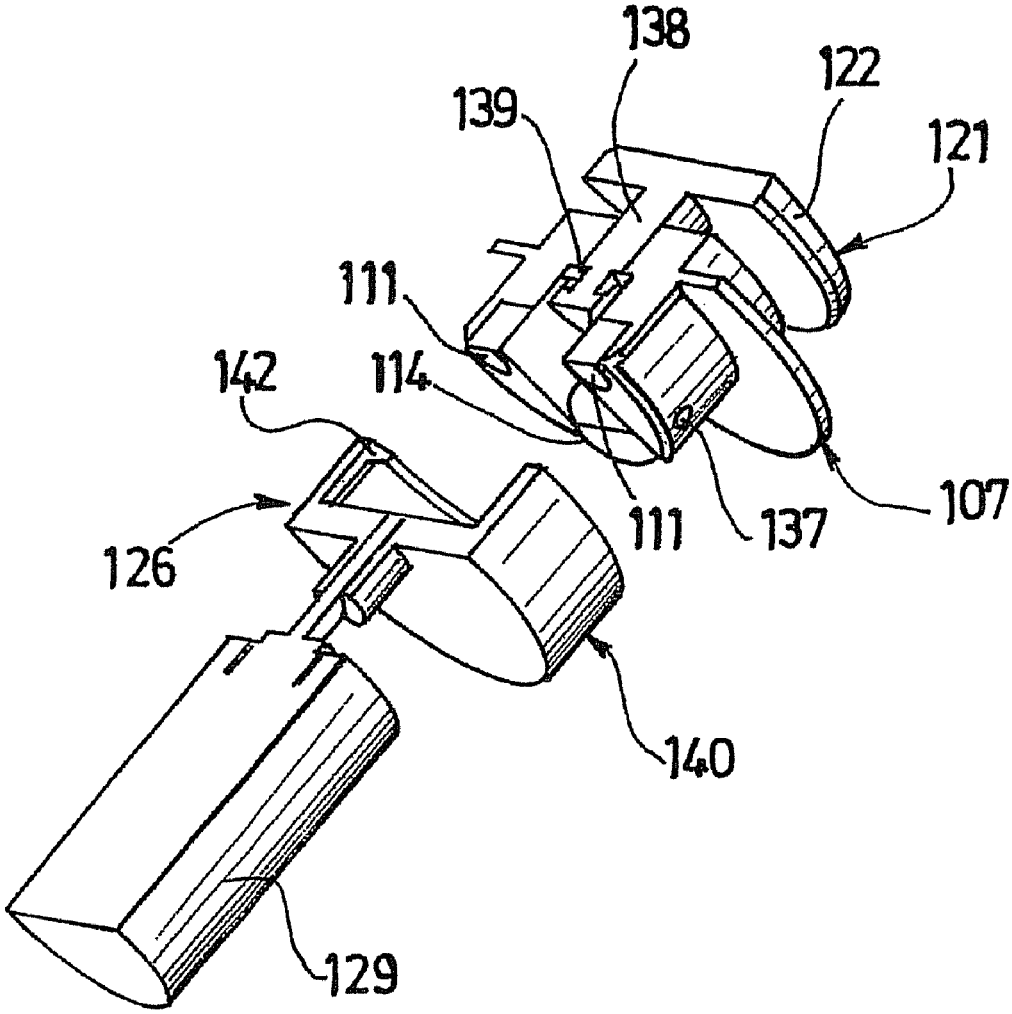
FIG. 17 is a view in perspective of another half of the impeller shown in FIG. 12, cut longitudinally at the magnets, before attachment to its corresponding hub.

Two link rods 114 are attached in each protuberance 130 as shown more specifically in FIGS. 16 and 17. More precisely, each link rod 114 has a first substantially cylindrical end 131, having a longitudinal ridge 132 forming a stop, and is connected via a stem 133 to a second protruding end 134 parallel to the shaft 135 of said first end 131. Each link rod 114 is then made fixedly attached to the impeller 107 thanks to the shaft 135 that is housed in two bores 137, made in the protuberances 130 and situated facing one another.

The latch 121 comprises a gripping member 122 of diskoid shape extended by a stem 138 in which a circular groove 139 is made close to its bottom end.

The hub 126 is made fixedly attached to a rotary motor 129 and is made in the form of a metal disk 140 having a hollow circular central portion 141 in which two nicks 142 each designed to house one of the ribs 120, are made.

The impeller 107 and the latch 121 are assembled in the hub 126 in the following manner.

First of all, the second end 134 forming a protrusion of each link rod 114 is inserted into the groove 139 of the shaft 135 of the latch 121 so that the latch 121 can move only between two extreme positions, namely a closed position (not shown) and an open position shown in FIGS. 16 and 17.

This subassembly thus formed is then fitted to the hub 126. When the hub 126 is lowered to come into the closed position, each link rod 114 pivots about its shaft 135 in one direction forcing the ridge 132 to separate from the bottom of the disk 140. Each link rod 114 therefore forms a transmission means allowing the magnets 111 to come into contact with the bottom of the disk 140.

When the user desires to clean the impeller 107, he grasps the gripping member 122 and pulls thereon. Each link rod 114 is then pulled in a rotary motion in opposite directions. The ridge 132 therefore butts against the bottom of the disk 140, which has the effect of gearing down the pulling action exerted on the gripping member 122 and makes separating the magnets 111 from the bottom of the disk 140 much easier. Each link rod 114 therefore forms a transmission means allowing the extraction of the locking means connecting the impeller 107 to the hub 126.

Although the invention has been described with reference to particular exemplary embodiments, it is evident that it is in no way limited thereto and that it covers all the technical equivalents of the means described and their combinations if the latter enter into the context of the invention.

The invention claimed is:

1. A removable impeller designed to be incorporated into a fan, comprising:

a wheel furnished with a plurality of blades and fitted with locking means to allow the wheel to be removably attached to a hub, and protruding transmission means positioned close to a central neck including an axis of revolution that is parallel to that of the wheel, and designed so as to alternately allow engagement or extraction of the locking means, wherein the locking means are arranged in the central neck in the form of a first series of locking clips evenly spaced from one another and each provided at a bottom with a radial swelling oriented outward, and wherein the transmission means are arranged in the central neck in the form of a second series of transmission clips evenly spaced from one another and interspersed with the locking clips, each transmission clip being fitted with a first stop and a second stop positioned one beneath the other and oriented inward, said first stop forming a more pronounced protrusion than the second stop.

2. The impeller as claimed in claim 1, wherein each locking clip has at the bottom a radial shoulder oriented outward.

3. The impeller as claimed in claim 1, wherein the first stop is arranged at the top, and the second stop is made in the form of a longitudinal boss extending in a mid-portion, and extended by an inclined face at each of a top and bottom end.

4. The impeller as claimed in claim 1, further comprising, on a periphery of the central neck, a central wall on which longitudinal ribs are made that are evenly spaced and oriented inward.

5. A fan, comprising a body forming a volute in which a rotary motor is attached, a hub being fixedly attached to said motor and supporting a removable impeller provided with a central neck, a plurality of blades and fitted with locking means to allow it to be attached to the hub, wherein, the locking means are made in the central neck in the form of a first series of locking clips evenly spaced from one another and each provided at a bottom, on the one hand, with a radial swelling oriented outward, and, on the other hand, with a radial shoulder oriented inward, the impeller comprises transmission means made in the central neck in the form of a second series of transmission clips evenly spaced from one another and interspersed with the locking clips, each transmission clip being fitted with a first stop and a second stop positioned one beneath the other and oriented inward, said first stop forming a more pronounced protrusion than the second stop, said first stop being made at a top and said second stop being made in the form of a longitudinal boss, extending in a mid-portion, extended by an inclined face at each of a top and bottom end, the hub comprises a lateral wall in which a series of notches is made, each of them being capable of housing one of the locking clips of the impeller, a latch is fitted to the impeller, this latch comprising a gripping member extended by a series of longitudinal flat walls interspersed with a series of longitudinal hollow walls, said flat walls and hollow walls being evenly spaced from one another and being capable of sliding through the central neck so that each is respectively placed facing a locking clip and a transmission clip.

6. A removable impeller designed to be incorporated into a fan, comprising:

a wheel furnished with a plurality of blades and fitted with a series of locking clips to allow it to be attached to a hub, and protruding transmission means positioned close to a central neck whose axis of revolution is parallel to that of the wheel, and designed so as to alternately allow engagement or extraction of the locking clips, each of the locking clips being provided at a bottom with a radial swelling oriented outward and a radial shoulder oriented inward.

7. A removable impeller designed to be incorporated into a fan, comprising:

a wheel furnished with a plurality of blades and fitted with locking means to allow the wheel to be removably attached to a hub, and protruding transmission means positioned close to a central neck including an axis of revolution that is parallel to that of the wheel, and designed so as to alternately allow engagement or extraction of the locking means, wherein the locking means comprise at least two magnets and the transmission means comprise at least two link rods each comprising a first substantially cylindrical end having a longitudinal ridge forming a stop, and connected via a stem to a second protruding end parallel to a shaft of the first end.

8. A removable impeller designed to be incorporated into a fan, comprising:

a wheel furnished with a plurality of blades and fitted with locking means to allow the wheel to be removably attached to a hub;

protruding transmission means positioned close to a central neck including an axis of revolution that is parallel to that of the wheel, and designed so as to alternately allow engagement or extraction of the locking means;

a latch fitted thereto, wherein the latch includes a gripping member and means capable of sliding through the central neck of the impeller, wherein the gripping member is extended by a series of longitudinal flat walls interspersed with a series of longitudinal hollow walls, said flat walls and said hollow walls being evenly spaced from one another.

9. The impeller as claimed in claim 8, wherein the gripping member is extended by a longitudinal stem in which a circular groove is made.

10. A removable impeller designed to be incorporated into a fan, comprising:

a wheel furnished with a plurality of blades and fitted with locking means to allow the wheel to be removably attached to a hub;

protruding transmission means positioned close to a central neck including an axis of revolution that is parallel to that of the wheel, and designed so as to alternately allow engagement or extraction of the locking means;

a hub configured to impart support thereto, the hub including a lateral wall in which a series of notches is made, each of them being capable of housing one of the locking means of the impeller.

11. The impeller as claimed in claim 10, wherein a lateral wall is fitted on an outer face with V-shaped indexing means.

* * * * *